US006877425B2

(12) United States Patent
Lynton

(10) Patent No.: US 6,877,425 B2
(45) Date of Patent: Apr. 12, 2005

(54) PIVOTABLE INK PAD SYSTEM

(75) Inventor: Jeanette R. Lynton, Pleasant Grove, UT (US)

(73) Assignee: Cabin Creek, Ltd., Pleasant Grove, UT (US)

( * ) Notice: Subject to any disclaimer, the term of this patent is extended or adjusted under 35 U.S.C. 154(b) by 0 days.

(21) Appl. No.: 10/717,816

(22) Filed: Nov. 20, 2003

(65) Prior Publication Data

US 2004/0168591 A1 Sep. 2, 2004

Related U.S. Application Data

(60) Provisional application No. 60/428,032, filed on Nov. 20, 2002.

(51) Int. Cl.[7] ..... B05C 21/00

(52) U.S. Cl. ..... 101/333; 101/108; 101/405; D18/17; 118/264

(58) Field of Search ..... 101/333, 334, 101/101, 104, 108, 405, 406; D18/15, 17; 118/264, 265; 434/84; 206/747, 766, 749, 751, 752, 755, 759

(56) References Cited

U.S. PATENT DOCUMENTS

| | | | | | |
|---|---|---|---|---|---|
| 3,326,180 | A | | 6/1967 | Lofgren | 118/264 |
| 3,678,848 | A | | 7/1972 | Roser et al. | 101/125 |
| 3,839,960 | A | | 10/1974 | Bissonet | 101/333 |
| 4,371,077 | A | * | 2/1983 | Solitt et al. | 206/759 |
| 4,497,275 | A | | 2/1985 | Johnson et al. | 118/268 |
| 4,553,476 | A | | 11/1985 | Kirby, Jr. | 101/111 |
| 5,462,595 | A | | 10/1995 | Im | 118/264 |
| 5,505,130 | A | | 4/1996 | Winston | 101/333 |
| 5,653,804 | A | | 8/1997 | Yasoshima | 118/46 |
| 6,178,885 | B1 | | 1/2001 | Yasoshima | 101/333 |
| 6,199,482 | B1 | * | 3/2001 | Yasoshima | 101/333 |
| 2001/0025579 | A1 | | 10/2001 | Winston | 101/327 |
| 2003/0089258 | A1 | | 5/2003 | Rigoni | 101/405 |

* cited by examiner

*Primary Examiner*—Andrew H. Hirshfeld
*Assistant Examiner*—Kevin D. Williams
(74) *Attorney, Agent, or Firm*—Berne S. Broadbent; Kirton & McConkie

(57) ABSTRACT

An ink pad assembly having a top panel, the top panel having an ink pad coupled thereto, a bottom panel, and a pivotable hinge for connecting the top and bottom panels. The top panel of the ink pad assembly can be opened and pivoted 180 degrees about its central lengthwise axis. This pivotability allows a user to place the ink pad assembly in a position ready for use wherein the top panel lies on top of the bottom panel so that the ink pad is exposed. The pivotable hinge also allows the user to place the ink pad assembly in a closed position wherein the top panel lies on top of the bottom panel so that the ink pad is enclosed between the top and bottom panels.

20 Claims, 6 Drawing Sheets

PIVOTABLE INK PAD SYSTEM

RELATED APPLICATION

This application claims priority to U.S. Provisional Patent Application Ser. No. 60/428,032, filed Nov. 20, 2002, and titled PIVOTABLE INK PAD.

BACKGROUND

1. Field of the Invention

The present invention relates generally to devices and methods for ink pad assemblies. More particularly, the present invention relates to ink pads that have a cover coupled thereto by means of a hinge.

2. Background

There are a variety of ink pads known in the art. Many of these ink pads have a cover that protects the ink pad from damage or dust; the cover also protects the ink on the ink pad from rubbing onto exterior surfaces as well as from drying out. One type of frequently used cover is a simple removable cover that fits snugly around the edges of a dish containing the ink pad. Another type of cover is attached to the ink pad dish via a simple hinge coupled to one end of the dish. When a person desires to use the latter type of hinged ink pad, the person flips the cover open so that the cover lays against the table or surface on which the ink pad dish rests. When the person is finished using the ink pad, he or she flips the cover back over the ink pad.

Existing ink pad assemblies are not without limitations, however. Ink pads that have detachable covers are prone to misplacement of the covers, thereby causing the ink pad to be exposed and to wipe onto other surfaces and eventually dry out. In addition, the covers of these ink pads take up unnecessary desk space while lying on a desk while the ink pad is being used. The ink pads that have a simple hinged cover also tend to take up unnecessary desk space when the cover is open and lying on the desk while the ink pad is being used.

SUMMARY OF THE INVENTION

The present invention can generally be characterized as an ink pad assembly having a top panel, the top panel having an ink pad coupled thereto, a bottom panel, and a pivotable hinge for connecting the top and bottom panels. The top panel of the ink pad assembly can be opened and pivoted 180 degrees about its central lengthwise axis. This pivotability allows a user to place the ink pad assembly in a position ready for use wherein the top panel lies on top of the bottom panel so that the ink pad is exposed. The pivotable hinge also allows the user to place the ink pad assembly in a closed position wherein the top panel lies on top of the bottom panel so that the ink pad is enclosed between the top and bottom panels.

Accordingly, it is an object of some embodiments of the present invention to provide an ink pad assembly having a reversible cover.

It is another object of some embodiments of the present invention to provide an ink pad having a cover coupled thereto by means of a pivotable hinge.

It is yet another object of some embodiments of the present invention to provide an ink pad assembly having a cover that rotates 180 degrees and remains attached to the ink pad assembly even when the ink pad is in use.

It is a further object of some embodiments of the present invention to provide an ink pad assembly that can be conveniently used on a small amount of desktop or surface space.

It is another object of some embodiments of the present invention to provide an ink pad assembly having a cover that is difficult to lose or misplace.

It is a further object of some embodiments of the present invention to provide a convenient method for covering an ink pad.

BRIEF DESCRIPTION OF THE DRAWINGS

The foregoing and other objects and features of the present invention will become more fully apparent from the accompanying drawings when considered in conjunction with the following description and claims. Although the drawings depict only one typical embodiment of the invention and are thus not to be deemed as limiting the scope of the invention, the accompanying drawings help explain the invention in added detail.

DETAILED DESCRIPTION OF THE PREFERRED EMBODIMENTS

The following detailed description, in conjunction with the accompanying drawings (hereby expressly incorporated as part of this detailed description), sets forth specific numbers, materials, and configurations in order to provide a thorough understanding of the present invention. The following detailed description, in conjunction with the drawings and appended claims, will enable one skilled in the relevant art to make and use the present invention.

A purpose of this detailed description being to describe the invention so as to enable one skilled in the art to make and use the present invention, the following description sets forth various specific examples, also referred to as "embodiments," of the present invention. While the invention is described in conjunction with specific embodiments, it will be understood, because the embodiments are set forth for explanatory purposes only, that this description is not intended to limit the invention to these particular embodiments. Indeed, it is emphasized that the present invention can be embodied or performed in a variety of ways. The drawings and detailed description are merely representative of particular embodiments of the present invention.

Reference will now be made in detail to several embodiments of the invention. The various embodiments will be described in conjunction with the accompanying drawings wherein like elements are designated by like numeric characters throughout.

Figure 1:
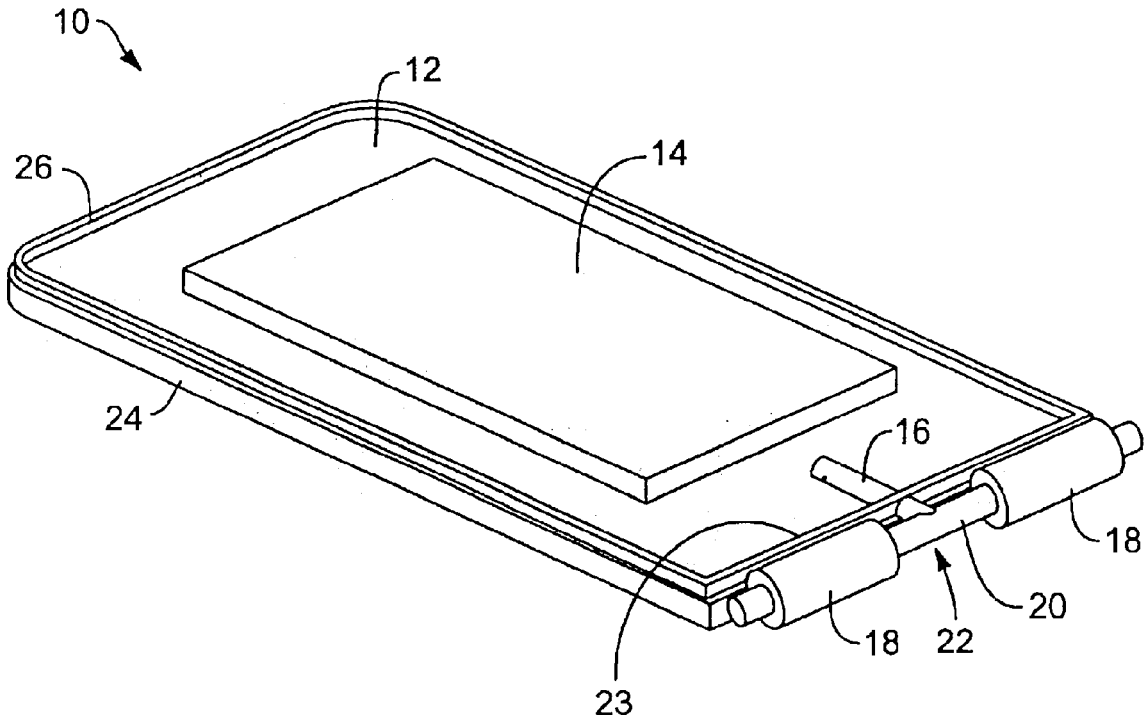
FIG. 1 is a perspective view of one embodiment of the ink pad assembly of the present invention wherein the ink pad is in a position ready for use.

FIG. 1 shows a perspective view of an ink pad assembly 10 having a top panel or cover 12, a bottom panel 24, an ink pad or stamp pad 14, and a pivotable hinge 22. The ink pad 14 is coupled to one surface of the top panel 12, and the pivotable hinge 22 couples together the top panel 12 and the bottom panel 24. The pivotable hinge 22 and the panels 12 and 24 can be made of any material, including metal, plastic, or wood. Likewise, the pivotable hinge 22 and panels 12 and 24 can be of any shape or size. For example, the panels 12 and 24 can be flat, curved, rectangular, circular, oblong, or square.

The pivotable hinge 22 comprises a hinge bar 20, at least one hinge mechanism 18 (note that the embodiment shown in the drawings has two hinge mechanisms 18), and a pivotable rod 16. The hinge mechanism 18 can be any sort of suitable hinge mechanism such as those used on cabinet doors (for example, a "hidden hinge" as is commonly known in the art of cabinetry). The hinge mechanism 18 encircles the hinge bar 20 and is fixed to a side of the bottom panel 24. Some embodiments of the hinge mechanism 18 may incorporate a spring (not shown) as well.

The pivotable rod 16 is fixedly coupled at one end to a side 23 of the top panel 12. In this embodiment, the rod 16 is shown as being exposed to the exterior; it should be noted that the rod 16 need not be exposed but can instead be enclosed within the top panel 12. The other end of the pivotable rod 16 is rotatably coupled to the hinge bar 20 by insertion into a hole (not shown) inside the hinge bar 20. This arrangement allows a person or user to rotate the top panel 12 around its central lengthwise axis at least 180 degrees when the top panel 12 is in an open position (to be described below). In an equivalent arrangement or embodiment, the pivotable rod 16 is rotatably coupled to the top panel 12; in this case, the pivotable rod 16 would be fixedly coupled to the hinge mechanism 18 or to the hinge bar 20.

In FIG. 1, the ink pad assembly 10 is in a position wherein the ink pad 14 is ready for use. In other words, the ink pad assembly 10 may be placed on a surface such as a desk, and the user may apply an item to be inked (for example, a rubber stamp) to the surface of the ink pad 14. Note that, in the position shown in FIG. 1, the ink pad 14 is faced outwardly.

Figure 2:
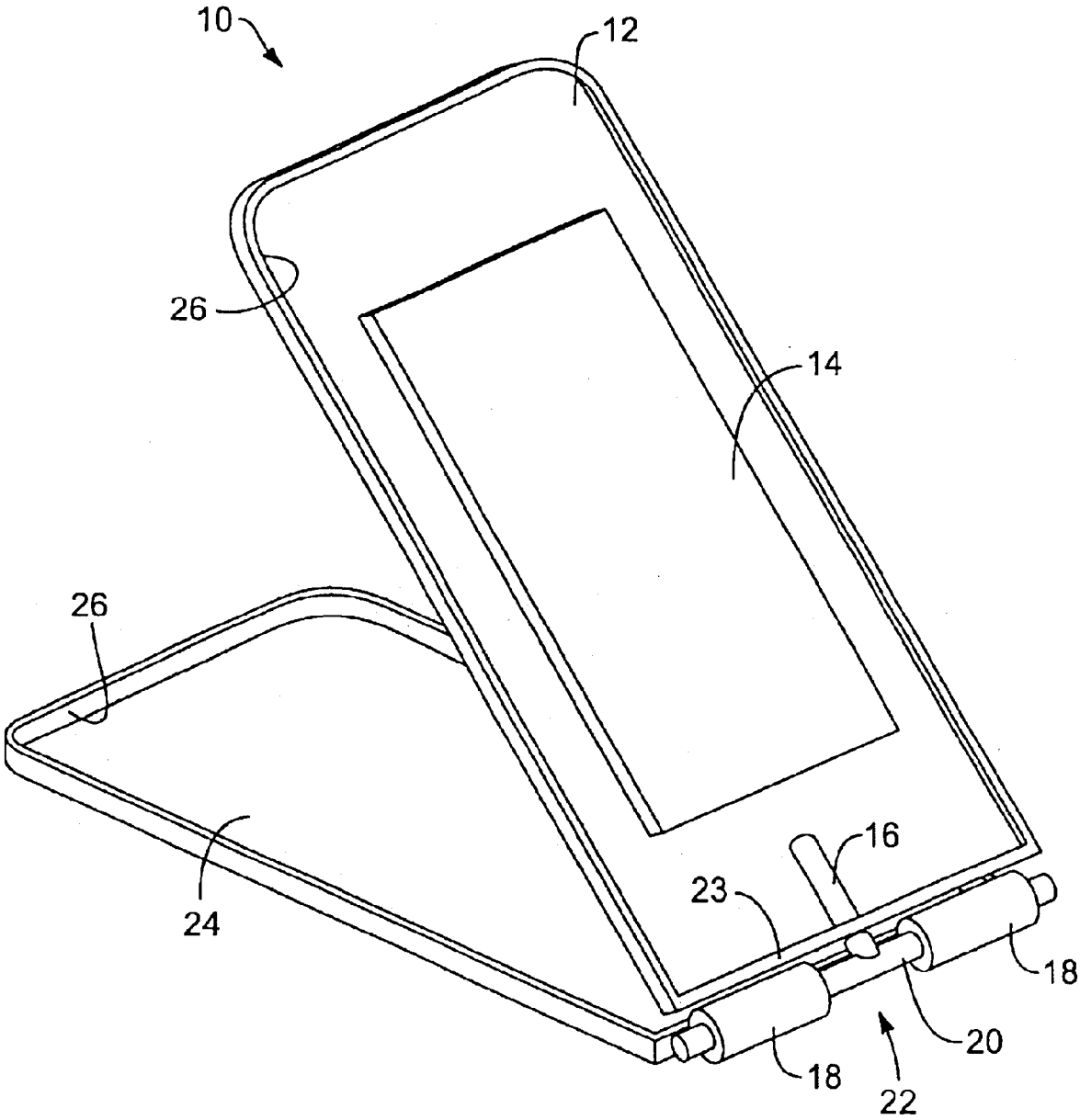
FIG. 2 is a perspective view of the embodiment shown in FIG. 1, this view showing the ink pad assembly in a partially open position.

In FIG. 2, the user has placed the ink pad assembly 10 in a partially open position by lifting the top panel 12. It will be noted that the hinge bar 20 and the hinge mechanism 18 allows the top panel 12 to be lifted in this manner.

Figure 3:
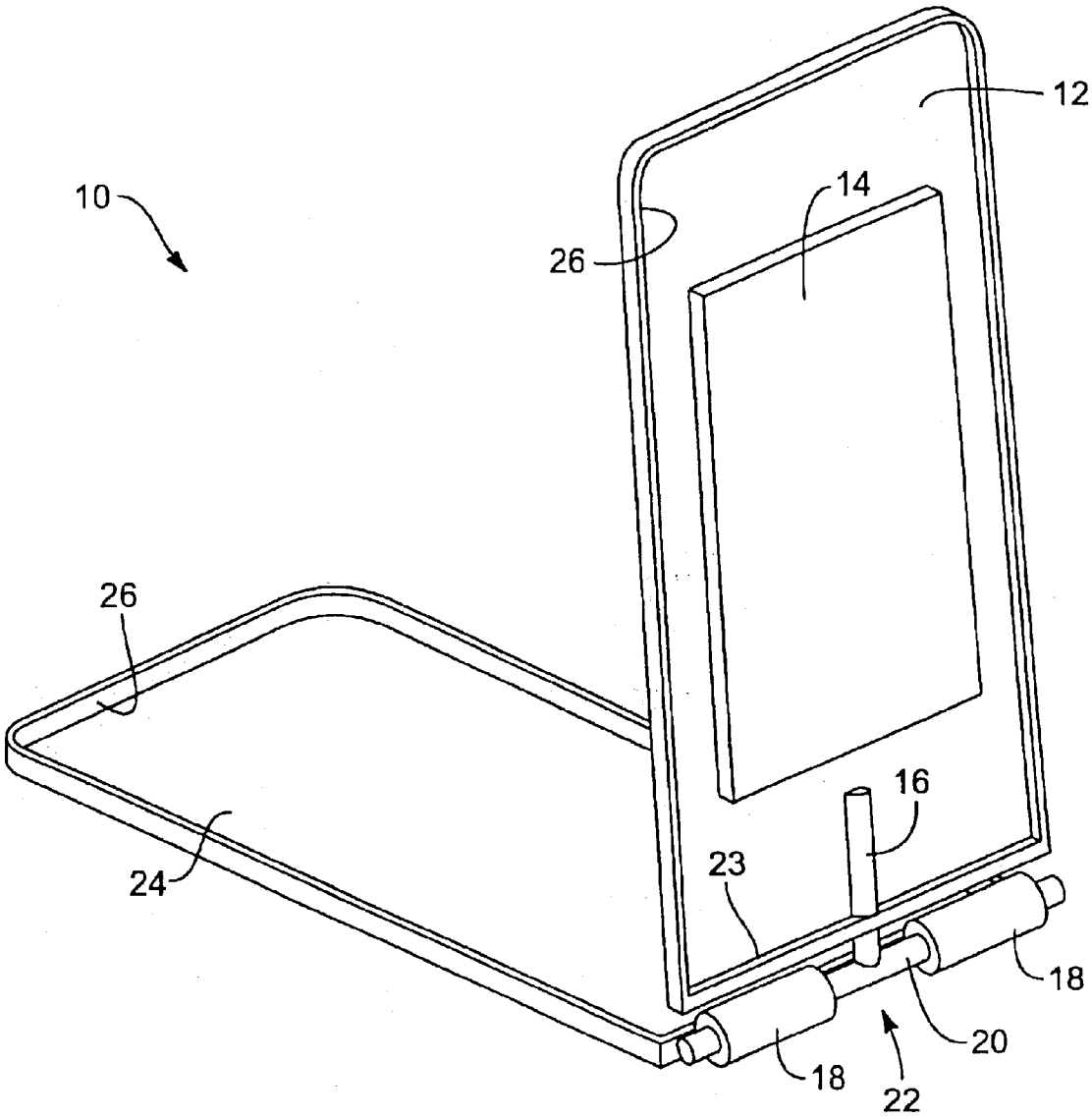
FIG. 3 is a perspective view of the embodiment shown in FIG. 1, this view showing the top panel (the panel coupled to the ink pad) in a position ready for rotation.

In FIG. 3, the ink pad assembly 10 is in an open position such that the top panel 12 is ready to be rotated 180 degrees around its central lengthwise axis.

Figure 4:
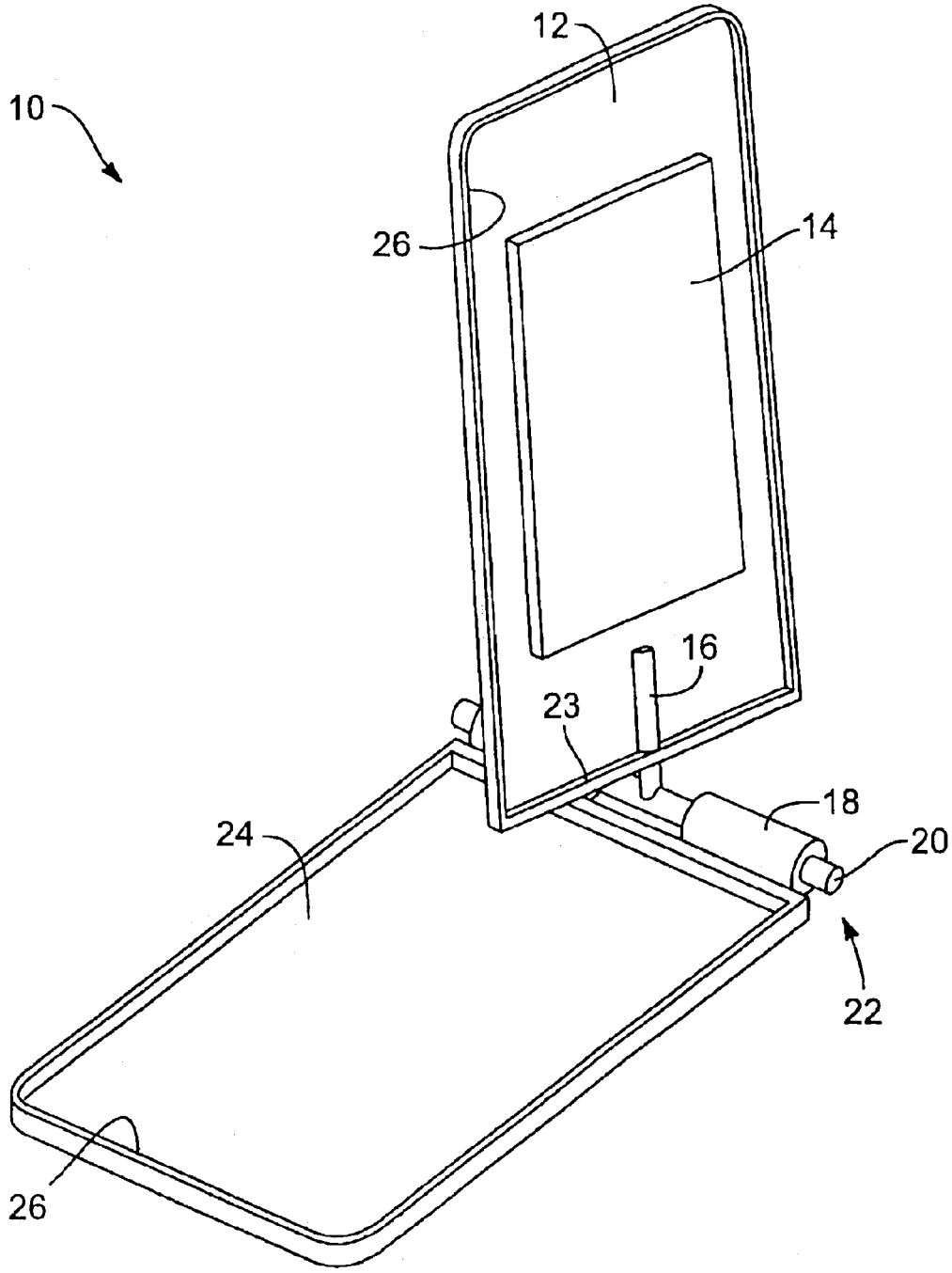
FIG. 4 is a perspective view of the embodiment shown in FIG. 1, this view showing the top panel being rotated.

FIG. 4 shows the top panel 12 being rotated about its central lengthwise axis. Note that the pivotable rod 16, being fixedly coupled to the top panel 12 and rotatably coupled to the hinge bar 20, rotates simultaneously with the top panel 12. During such rotation, the end of the pivotable rod 16 that is inserted into the hole in the hinge bar 20 rotates within the hole in the hinge bar 20. In other embodiments of the present invention, the pivotable rod 16 may be instead fixedly connected to the hinge bar 20 and rotatably inserted into a hole in the top panel 12. In the latter embodiments, the pivotable rod 16 remains stationary while the top panel 12 rotates around the pivotable rod 16.

Figure 5:
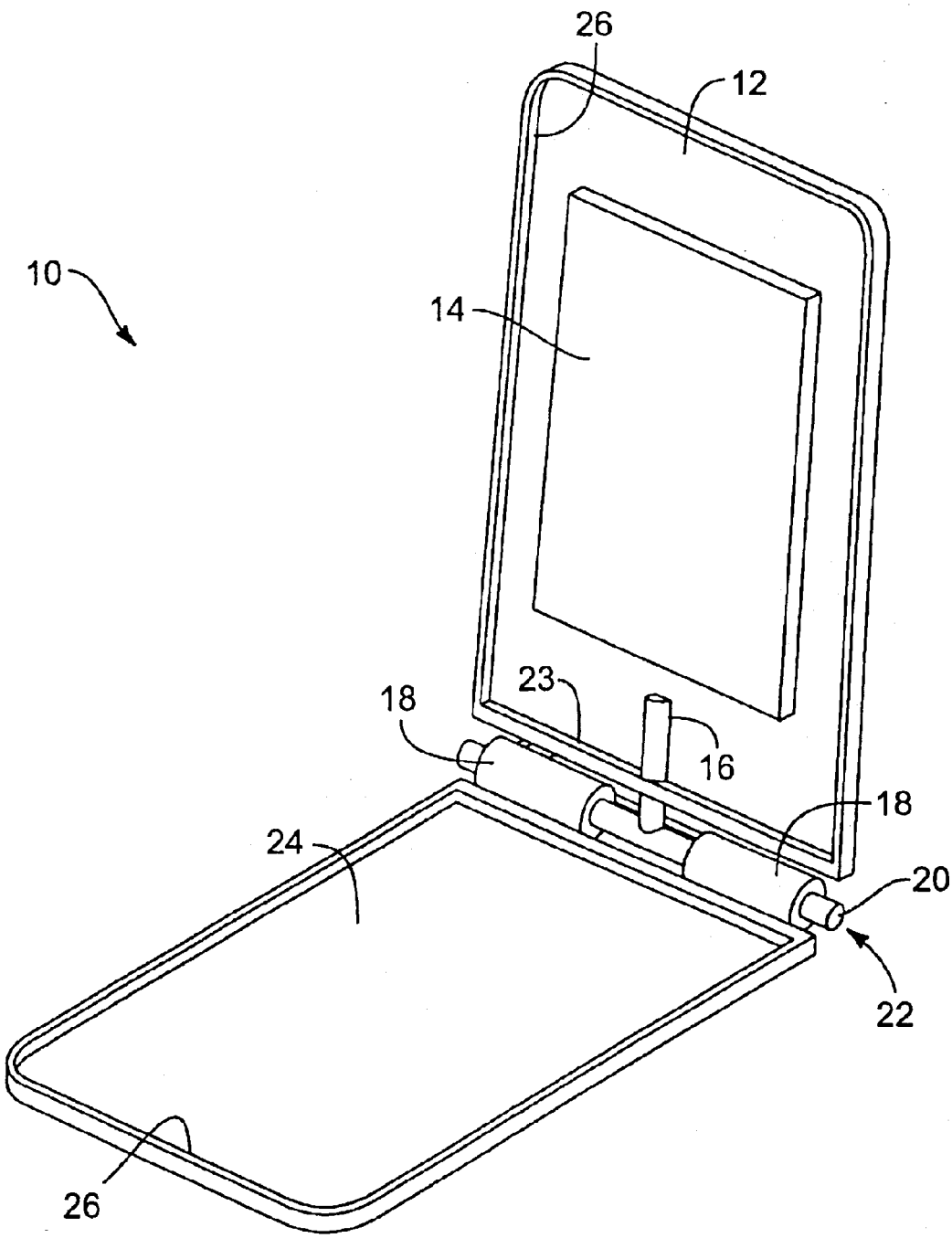
FIG. 5 is a perspective view of the embodiment shown in FIG. 1, this view showing the ink pad assembly in an open position, the ink pad facing inwardly towards the bottom panel.

FIG. 5 shows the top panel 12 still in an open position. However, in this position, the ink pad 14 on the top panel 12 is facing inwardly towards the bottom panel 24. It should be noted that, after applying ink to the surface of the bottom panel 24 by pressing the ink pad 14 on the top panel 12 against the bottom panel 24, a user might wish to lay both the top panel 12 and the bottom panel 24 flat on the surface (such as a desk) upon which the ink pad assembly 10 sits. In the latter position, the user might apply the item to be inked (such as a rubber stamp) to the ink now present on the surface of the bottom panel 24, thus using the ink pad assembly 10 in a manner analogous to painting in watercolor.

Figure 6:
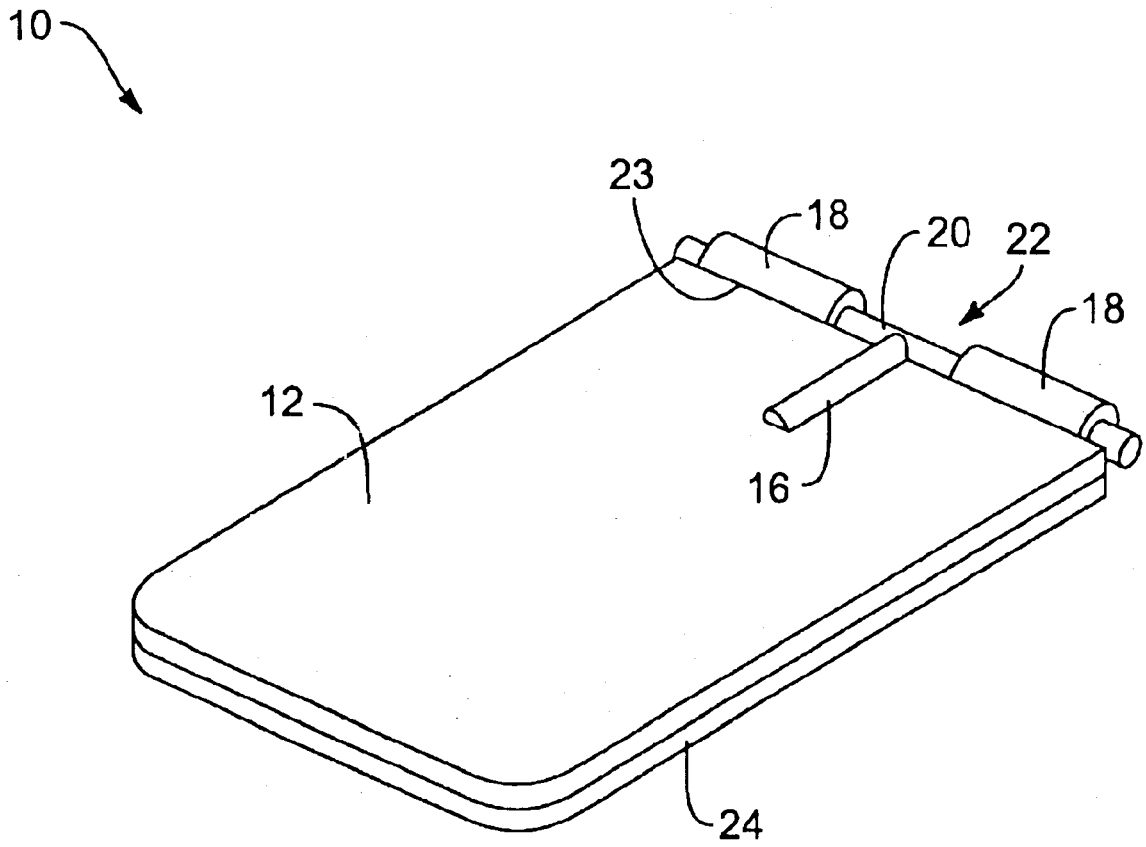
FIG. 6 is a perspective view of the embodiment shown in FIG. 1, this view showing the ink pad assembly in a closed position.

Finally, FIG. 6 shows the ink pad assembly 10 in a closed position wherein the ink pad 14 is protected from the exterior. It will be noted that, in the embodiments shown in these drawings, the top panel 12 and the bottom panel 24 have a raised edge 26. This raised edge 26 is deep enough so that when the ink pad assembly 10 is in the closed position shown in FIG. 6, the ink pad 14 is entirely enclosed within a cavity created by the top panel 12, the bottom panel 24, and the raised edge 26.

Hence, the present invention provides a convenient ink pad assembly 10 that incorporates an ink pad cover 12 that takes up little desk space and is difficult to misplace. This unique invention is able to provide these convenient features because the cover or top panel 12 can rotate to effectively create a reversible cover for the ink pad 14.

It is underscored that the present invention may be embodied in other specific forms without departing from its spirit or essential characteristics. The described embodiments herein should be deemed only as illustrative. Indeed, the appended claims indicate the scope of the invention; the description, being used for illustrative purposes, does not limit the scope of the invention. All variations that come within the meaning and range of equivalency of the claims are to be embraced within their scope.

What is claimed is:

1. A system comprising:

a first panel;

a second panel;

an ink pad coupled to one of said panels; and a pivotable hinge, coupled to both of said first and second panels, for rotating the first panel with respect to the second panel between an open and a closed position, and also for rotating the first panel perpendicularly with respect to the second panel.

2. The system of claim 1 wherein the pivotable hinge further comprises a hinge mechanism coupled to at least one of the panels, a hinge bar seated inside the hinge mechanism, and a pivotable rod coupled to the first panel.

3. The system of claim 2 wherein the pivotable rod is fixedly coupled to the first panel.

4. The system of claim 3 wherein the pivotable rod further comprises a first end and a second end, the first end being fixedly coupled to the first panel, the second end being rotatably seated in a hole in said hinge bar.

5. The system of claim 3 wherein the pivotable rod further comprises a first end and a second end, the first end being fixedly coupled to the first panel, the second end being rotatably seated in a hole in said hinge mechanism.

6. The system of claim 2 wherein the pivotable rod is rotatably coupled to the first panel.

7. The system of claim 6 wherein the pivotable rod further comprises a first end and a second end, the first end being rotatably seated in a hole in the first panel, the second end being fixedly coupled to said hinge bar.

8. The system of claim 6 wherein the pivotable rod further comprises a first end and a second end, the first end being rotatably seated in a hole in the first panel, the second end being fixedly coupled to said hinge mechanism.

9. The system of claim 1 wherein said first and second panels are rectangular, each panel having two long sides and two short sides, and wherein said pivotable hinge is coupled to one short side of the first panel and one short side of the second panel.

10. The system of claim 1 wherein said first panel further comprises a first axis about which it can rotate between said open and closed positions, and a second axis about which it can rotate perpendicularly with respect to the second panel, the first and second axes lying at an angle from each other.

11. A system comprising:

a first cover;

a second cover;

an ink pad coupled to the first cover; and a pivotable hinge, coupled to both of said first and second covers, said first cover further comprising a first axis about which it can rotate via the pivotable hinge between open and closed positions, and a second axis about which it can rotate, via the pivotable hinge, perpendicularly with respect to the second cover, the first and second axes lying at an angle from each other.

12. The system of claim 11 wherein the pivotable hinge further comprises a hinge mechanism coupled to at least one of the covers, a hinge bar seated inside the hinge mechanism, and a pivotable rod coupled to the first cover.

13. The system of claim 12 wherein the pivotable rod is fixedly coupled to the first cover and rotatably coupled to the second cover.

14. The system of claim 11 wherein the pivotable rod further comprises a first end and a second end, the first end being fixedly coupled to the first cover, the second end being rotatably seated in a hole in said hinge bar.

15. The system of claim 11 wherein the pivotable hinge further comprises a pivotable rod rotatably coupled to the first cover and fixedly coupled to the second cover.

16. The system of claim 11 wherein the pivotable hinge further comprises a pivotable rod having a first end and a second end, the first end being rotatably seated in a hole in the first cover, the second end being fixedly coupled to a hinge bar.

17. The system of claim 11 wherein said first and second covers are rectangular, each cover having two long sides and two short sides, and wherein said pivotable hinge is coupled to one short side of the first cover and one short side of the second cover.

18. The system of claim 17 wherein said first axis is parallel and adjacent to the short sides coupled to the pivotable hinge, and the second axis is parallel to the long sides of the covers and runs centrally through the first cover.

19. A system comprising:

a first panel rotatable around a first axis and a second axis, the first and second axes being angled from each other;

a second panel coupled to said first panel, the second panel being rotatable around said first axis;

an ink pad coupled to one of said panels; and means for rotating said first panel around the first axis between an open and a closed position, and for rotating said first panel perpendicularly with respect to the second panel between reversible positions.

20. The system of claim 19 wherein said first panel can lie on top of said second panel in two types of positions, a first type wherein the ink pad is enclosed between the first and second panels, and a second type wherein the ink pad is exposed to the exterior environment.

* * * * *